United States Patent [19]

Daimon et al.

[11] Patent Number: 4,849,629

[45] Date of Patent: Jul. 18, 1989

[54] CHARGED PARTICLE ANALYZER

[75] Inventors: Hiroshi Daimon; Shozo Ino, both of Tokyo, Japan

[73] Assignee: Shimadzu Corporation, Kyoto, Japan

[21] Appl. No.: 120,155

[22] Filed: Nov. 13, 1987

[30] Foreign Application Priority Data

Nov. 14, 1986 [JP] Japan ..... 61-271545

[51] Int. Cl.[4] ..... H01J 40/00; H01J 47/00

[52] U.S. Cl. ..... 250/305; 250/309

[58] Field of Search ..... 250/305, 309, 310; 324/158 R

[56] References Cited

U.S. PATENT DOCUMENTS

| | | | |
|---|---|---|---|
| 4,255,656 | 3/1981 | Barrie et al. | 250/305 |
| 4,546,254 | 10/1985 | Yamauchi | 250/305 |
| 4,633,084 | 12/1986 | Gruen et al. | 250/309 |
| 4,728,790 | 3/1988 | Plies | 250/305 |

FOREIGN PATENT DOCUMENTS

| | | | |
|---|---|---|---|
| 0000488 | 1/1977 | Japan | 250/305 |
| 0078362 | 1/1983 | Japan | 250/305 |
| 475686 | 9/1975 | U.S.S.R. | 250/305 |

*Primary Examiner*—Bruce C. Anderson

*Attorney, Agent, or Firm*—Birch, Stewart, Kolasch & Birch

[57] ABSTRACT

A charged particle analyzer comprises a spherical grid, a spherical electrode, a screen plate, and a detector. The spherical electrode is outside of the spherical grid and is concentric with the spherical grid. The screen plate has an entry window and an exit opening, which are symmetrical with the center of the sphere of the spherical grid. A sample is disposed at the entry window of the screen plate. The detector is positioned behind the exit opening to detect charged particles emitted from the sample. The charged particles having the same energy can travel through the exit opening of the screen plate, and their amount or their angular distribution is measured.

12 Claims, 2 Drawing Sheets

CHARGED PARTICLE ANALYZER

BACKGROUND OF THE INVENTION

The present invention relates to an apparatus for analyzing composition, structure, an electronic condition and the like of a sample by measuring the energy and direction distribution of the movement of charged particles emitted from the sample, and more particularly to an apparatus for analyzing energy distribution of charged particles emitted from a sample or two-dimensional direction distribution of charged particles having specific energy.

FIG. 3 shows an analyzer proposed by Eastman et al. The analyzer is characterized by comprizing a low-pass filter composed of a ellipsoidal mirror M and a grid G3 and a high-pass filter composed of spherical grids G4 and G5 being concentric. A sample S is positioned at one of the focuses of the ellipsoidal mirror M. A small opening A is arranged at the other of the focuses of the ellipsoidal mirror M. A two-dimensional detector D is provided at the outside of the grids G4 and G5.

In the above-stated apparatus, in principle, the number of the grids G3, G4, and G5 is three. Actually, additional accelerating grids G5 and G6 are needed to accelerate the charged particles to operate the two-dimensional detector D. An additional grid G7 is needed for the charged particles to travel straight between the grid G6 and the detector D. Further, two additional grids G1 and G2 being concentric and double-sphere are provided around the sample S. Totally, eight grids are needed. Fundamentally, the image of the direction distribution of the charged particles is distorted. Regarding an orbit b and another orbic c of the charged particle with an angle $\theta$ around an orbit a of the charged particles emitted from the same S, when the direction of the orbits b and c is somewhat changed, the direction at the opening A is changed in which the direction change of the orbit b is reduced and that of the orbit c is magnified. To amend this distortion, the plane of the detecter D is rotated clockwise about an axis perpendicular to the drawing in FIG. 3. In order to amend the distortion in this manner, the value of the angle $\theta$ is not much. Further, the image on the detector D of the charged particles emitted along a circular cone having a vertical angle of 2 $\theta$ around the orbit a is not circular. As a still further fundamental fault, in connection with the orbit of electrons unlike that of light, the ellipsoidal mirror is provided in which an imaginary reflection supposed on the base of the orbits of electrons does not correctly equal the plane of the ellipsoidal mirror. This discrepancy becomes much as a solid angle is greater, so that it becomes difficult to converge the electrons. Therefore, a great solid angle cannot be measured.

Moreover, it is difficult to make the ellipsoidal mirror M. When the ellipsoidal mirror M is replaced by a spheroid mirror, the charged particles cannot gather precisely at the position of the opening A if the distance between the sample S and the opening A is short as compared to the diameter of the spherical mirror. However, as the orbits of the charged particles are far from the central orbit a, an aberration becomes remarkable. On account of limiting the aberration, the solid angle to be measured is further reduced.

SUMMARY OF THE INVENTION

Accordingly, it is an object of the present invention to provide an improved simple apparatus for analyzing the energy of charged particles emitted from a sample over a wide solid angle.

It is another object of the present invention to provide an improved simple apparatus for analyzing angular distribution of the specific energy of charged particles emitted from a sample over a wide solid angle by providing a single spherical grid and a single spherical electrode.

Other objects and further scope of applicability of the present invention will become apparant from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description. To achieve the above objects, pursuant to an embodiment of the present invention, a charged particle analyzer comprises a spherical grid, and a spherical electrode, which is positioned at the outer side of the spherical grid and is concentric with the spherical grid. A sample is disposed at the inner side of the grid and far from the spherical center of the grid. A screen plate is provided which has an opening symmetrical with the position of the sample in connection with the spherical center of the grid. A two-dimensional detector is positioned behind the opening to detect charged particles in a two-dimensional manner.

BRIEF DESCRIPTION OF THE DRAWINGS

The present invention will become more fully understood from the detailed description given hereinbelow and accompanying drawings which are given by way of illustration only, and thus are not limitative of the present invention and wherein.

DESCRIPTION OF THE PREFERRED EMBODIMENT

Figure 1:
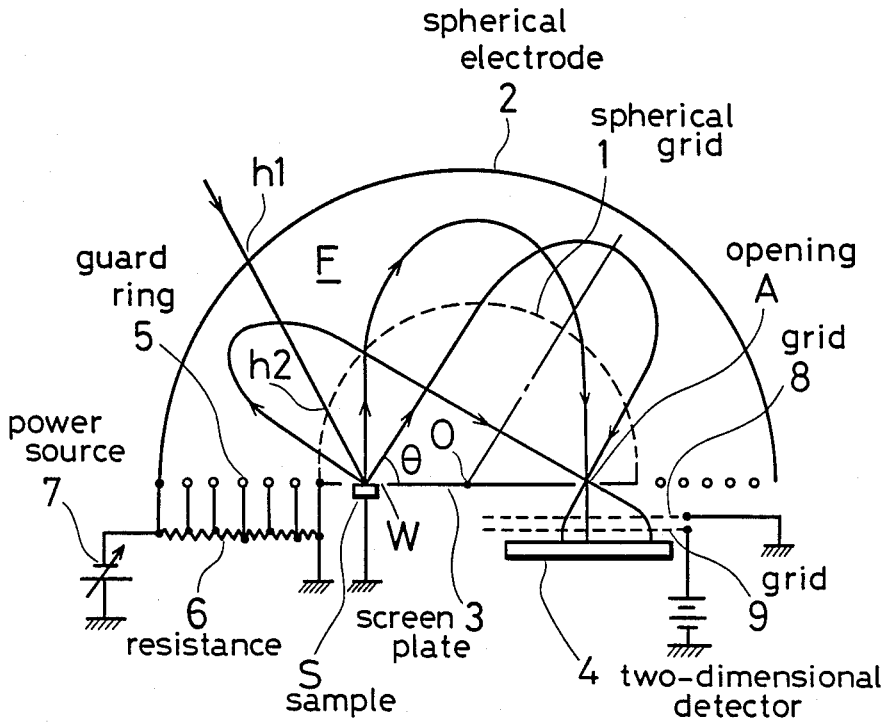
FIG. 1 shows a cross-sectional view of a charged particle analyzer according to a preferred embodiment of the present invention.

FIG. 1 shows a cross-sectional view of the charged particle analyzer according to a preferred embodiment of the present invention. The charged particle analyzer comprises a spherical grid 1, a spherical electrode 2, a screen plate 3, and a two-dimensional dimensional detector 4. The spherical electrode 2 is positioned at the outer side of the spherical grid 1 and is concentric with it. A sample S is disposed at the inner side of the spherical grid 1 and far from the spherical center of the spherical grid 1. The screen plate 3 has an exit opening A symmetrical with the position of the sample S in connection with the spherical center of the grid 1. The two-dimensional detector 4 is positioned behind the opening to detect charged particles in a two-dimensional manner.

In the above-mentioned charged particle analyzer, it is assumed that charged particles emitted from the sample S are electrons. The voltage of the spherical grid 1 is set the same as that of the sample S. Zero voltage is set within the spherical grid 1 and under the obstacle plate 3. The voltage of the spherical electrode 2 is set in a certain negative voltage with respect to that of the spherical grid 1. The electrons emitted from the same S travel through an entry window W straight toward the spherical grid 1, so that they are introduced into a space F between the spherical grid 1 and the spherical electrode 2. Within the space F, the electrons travel along an elliptical orbit one of the focus of which is the center of the spherical grid 1. Depending upon the energy and the emission directions of the electrons, some electrons may be incident upon the spherical electrode 2 and be absorbed by it, and some electrons may be repelled within the space F and be back within the inner side of the spherical grid 1. Specific electrons having particular energy may travel in a first way from the sample S to the spherical grid 1, and in a second way from the outside of the spherical grid 1 into the inside of the grid 1. The first way is parallel with the second way. FIG. 1 shows such specific three types of electrons. A major axis of each elliptical orbit of such a specific type is defined to be a straight line between the center 0 of the grid 1 and the farthest point of the elliptical portion of the elliptical orbit. With respect to the major axis, each elliptical orbit is symmetrical. The specific electron, having particular energy, emitted from the sample S can pass, i.e., exit the opening A with an angle $\theta$ being the same as an angle at which the specific electron is emitted from the sample S. Thus, the image of the sample S with the specific electrons having particular energy is directly formed at the opening A. Since the two-dimensional detector 4 is behind the opening A, the detector 4 can provide a distribution image according to the angular to distribution of the specific electrons having the particular energy. The distribution image is free of substantial distortion although some distortion derived from projecting a sphere to a plan may not be avoided. If a spherical detector with the center of the opening A is provided, such distortion can be avoided.

According to the present invention, the specific charged particles having particular energy can converge on the opening A to thereby pass through it. Other charged particles not having the particular energy can be scattered by the screen plate 3 not to thereby pass through it. Thus, the charged particles having selected energy can be selected. In principle, it is satisfactory that the spherical grid 1 is single. In order to accelerate the charged particles to operate the two-dimensional detector 4, two additional grids, centering the position of the opening A are enough. Since the electrode 2 and the grid 1 are both spherical, the structure of the analyzer is very simple.

Figure 2:
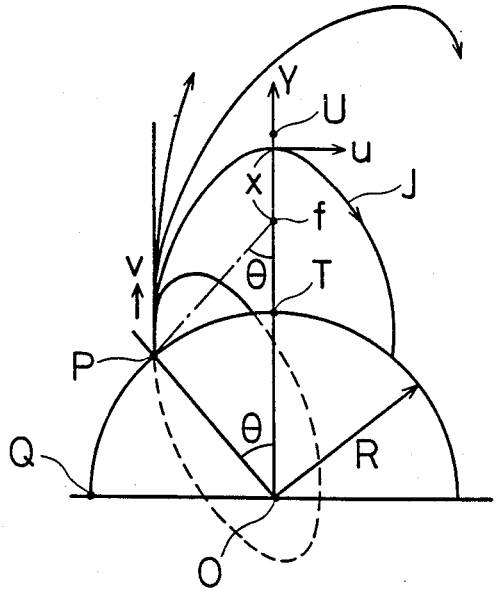
FIG. 2 is a drawing of explaining the orbits of electrons within the charged particle analyzer of FIG. 1.

The following is a brief explanation of the reason why the charged particles showing the example orbits as illustrated in FIG. 1 have the identical energy. It is assumed that, around a sphere with a radius R, a field of an attractive force is provided at the outside of the sphere, which is inversely proportioned to the square of a distance between a point and the center 0 of the sphere. When charged particles are emitted to the direction parallel with the direction of Y-axis of FIG. 2, starting from a point P on the sphere, they travel along different elliptical orbits depending on their velocity as illustrated in FIG. 2. One of the focuses of all these elliptical orbits is the center of the sphere. A group of orbits are considerd below whose major axes agree with the direction of Y-axis. Among these elliptical orbits, a specific charged particle is present which is emitted from a top T of the sphere along the Y-axis and travels along a linear orbit up to a point U defined by TU=R. Another specific charged particle is emitted from a side Q of the sphere along the Y-axis and travels on an arc along the shape of the sphere. Initial velocities of these charged particles are calculated upon the emission from the sphere. An attractive force g is given on the sphere. A potential energy E at the point U is calculated based on the point T.

$$E=gR/2$$

When a mass of the charged particle is m, the initial velocity v of the charged particle emitted from the point T and backed at the point U in FIG. 2 is calculated under the condition that the kinetic energy is equal to the potential energy.

$$\tfrac{1}{2}mv^2=\tfrac{1}{2}gR$$

Therefore, $v=\sqrt{gR/m}$

The initial velocity v' of the charged particle traveling along a spherical orbit around the surface of the sphere is given.

$$v'=\sqrt{gR/m}$$

Thus, $v=v'$.

In a general case, an orbit J of a charged particle in FIG. 2 is considered which is symmetric in connection with a horizontal line passing through a starting point P on the surface of the sphere. The upper focus f of the orbit J is distant from the center of the sphere by 2R $\cos\theta$. The distance X between the top of the orbit J and the focus is calculated from the fact that the sum of the length of lines connecting a point on an ellipse and each of the focuses is constant to be and the value is 2R.

$$X=R\ (1-\cos\theta)$$

Thus, a distance between the center 0 of the sphere and the top of the orbit J is R $(1+\cos\theta)$. A horizontal velocity at the top of the orbit is defined u. According to a law of constant areal velocity.

$$Rv\sin\theta = R(1+\cos\theta)u$$

$$\therefore\ u = \frac{\sin\theta}{1+\cos\theta}\,v$$

The potential energy L at the top of the orbit is $$L = \frac{gR\cos\theta}{1+\cos\theta}$$

The kinetic energy K at the top of the orbit;

$$K = \frac{mv^2\sin^2\theta}{2\,(1+\cos\theta)^2}$$

The potential energy L is equal to the subtraction of the kinetic energy K from a kinetic energy at the starting point on the surface of the sphere.

$$\frac{1}{2}mv^2\left(1-\frac{\sin^2\theta}{(1+\cos\theta)^2}\right)=\frac{gR\cos\theta}{1+\cos\theta}$$

-continued $$\therefore \frac{1}{2} mv^2 (1 + 2\cos\theta + \cos 2\theta) = \frac{gR}{2} (1 + 2\cos\theta + \cos 2\theta)$$

By canceling the term including $\theta$, $v=\sqrt{gR/m}$ is given. Thus, it is certified that the charged particles of the orbits whose major axis is parallel to the Y-axis have the same initial velocity. In other words, as far as the the directions of the elliptical orbits are parallel at two crossings between the elliptical orbits and the sphere, the particles have the same initial velocity. All the orbits illustrated in FIG. 1 belong to this group, so that all the particles have the same initial velocity. Since the attractive force is defined with the potential difference between the spherical electrode 2, the energy of the charged particles to be detected can be freely selected by changing the potential difference between the spherical grid 1 and the spherical electrode 2.

A preferred embodiment of the present invention will be described below. In the charged particle analyzer of FIG. 1, the radius of the spherical electrode 2 is double the radius of the concentric spherical grid 1. Theoretically, if the radius of the spherical electrode 2 is double the radius of the spherical grid 1, the whole portions of hemisphere starting from the position of the sample, namely, a solid angle of 2 $\pi$ steradian can be measured at once. When a large angle is not required, it may be possible for the spherical electrode 2 to have a radius less than double the radius of the spherical grid 1. Some guard rings 5 are provided between the edge of the spherical grid 1 and the spherical electrode 2. The rings 5 are positioned as concentric circles. Some resistances 6 are provided whose one end is connected to the grid 1 and grounded, and whose other end is connected to the electrode 2 and the negative terminal of a power supply 7. The guard rings 5 prevent the electric field from disturbing near the edges of the grid 1 and the electrode 2. The screen plate 3 is positioned at the bottom of the hemispherical grid 1. The plate 3 is made of a conductive material and grounded. With the above construction, the energy of the charged particles to be detected can be selected by changing the output voltage of the power source 7. The entry window W is formed in the screen plate 3 to enable the sample S to be set. The window W is separated from the center 0 of the grid 1 by a distance a bit shorter than the radius of the grid. With respect to the center the exit opening A is symmetric with the window W. Small holes $h_1$ and $h_2$ are punched in the spherical grid 1 and the spherical electrode 2, respectively. An exciting ray such as X-ray is incident on the sample S through the small holes $h_1$ and $h_2$. The two-dimensional detector 4 is disposed below the screen plate 3 and faced to the opening A. For example, the detector 4 may be a fluorescent screen. Grids 8 and 9 are set above and parallel with the detector 4. While the grid 8 is grounded, a positive high voltage is supplied to the grid 9. The electrons passing through the grid 8 are accelerated in the direction normal to the detector 4 between the grids 8 and 9 to collide with the detector 4, so that the fluorescent screen throw lights. The pattern on the fluorescent screen 4 shows emission direction distribution of specific charged particles having particular energy, the specific charged particles being among all the particles emitted by the sample S. In place of the fluorescent screen 4, a micro channel plate can be used to convert the distribution pattern of the electrons into electrical image signals representative of the distribution pattern. Further, instead of the two-dimensional detector, a one-dimensional detector can be provided whose detection surface is scanned in one direction.

When the analyzer of FIG. 1 is structured in that the radius of the electrode 2 is about 7 cm, the distance between the center 0 and the center of the entry window W and between the center 0 and the center of the exit opening A is about 5 cm, and the diameter of the opening A is about 1 mm, the energy resolution ($\Delta E/E$) is about 1/100. The energy resolution can be improved as the locations of the sample S and the opening A become close to the edge of the grid 1. A high pass filter may be provided under the opening A to further improve the energy resolution. The high-pass filter comprises a double hemisphere grid concentric at the opening A. In the case where the high-pass filter is used, the positions of S and A are preferably close to the center 0.

As described above, according to the present invention, the emission direction distribution of the specific charged particles, having particular energy among all the particles emitted from the sample S, is measured. When a detector without position resolving power is positioned at the detector 4, the energy distribution of all the charged particles emitted within the wide solid angle can be measured. As all the charged particles emitted within the wide solid angle can be measured, the energy analyzer providing high brightness can be established. It works not only for the charged particles emitted from samples but also for the charged particles which are focussed at the center of the window W and diverge.

Figure 3:
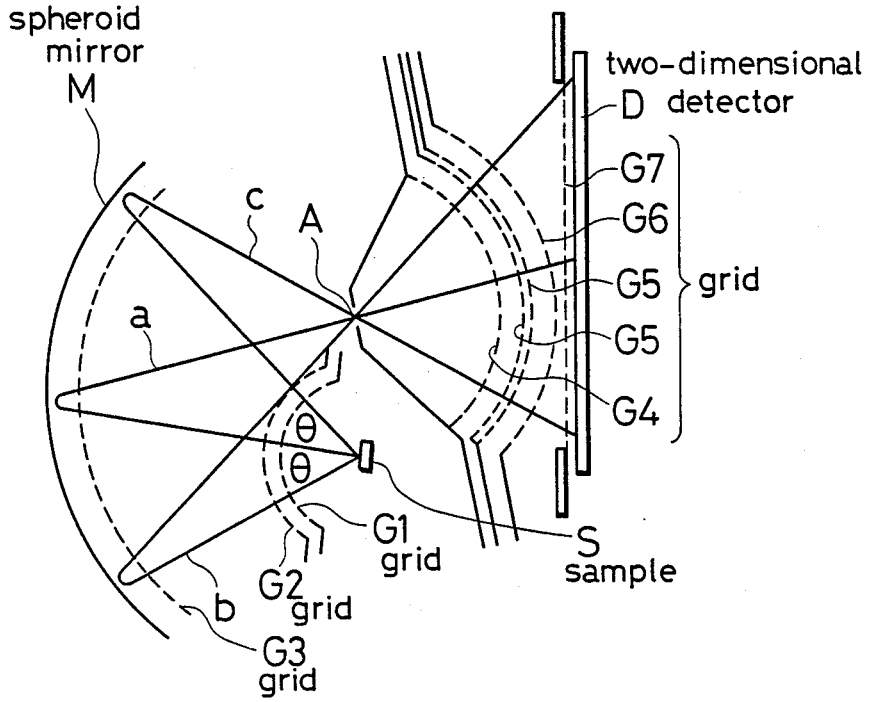
Fig. 3 (PRIOR ART)
FIG. 3 shows a cross-sectional view of the conventional charged particle analyzer.

As described above, the analyzer of the present invention mainly comprises a pair of hemispheric and concentric grid and electrode which is very simple as compared to the structure of the analyzer of FIG. 3 requiring the low pass filter and the high pass filter. The number of the grids should be as few as possible because the orbits of the charged particles traveling close to or incident upon the wires of the grids are disturbed, so that such charged particles traveling on the disturbed orbits cause the background. Further, other charged particles having the energy intended not to be detected may reach the detector more. Therefore, the sensitivity of the detector may be reduced and the background may be increased. However, according to the present invention, fundamentally, the grid is single while the analyzer of FIG. 3 requires at least three grids. The ratio, at which the specific charged particles having the particular energy intended to be detected reach to detector, is about 66% in the analyzer of the present invention while about 34% in the analyzer of FIG. 3. This means that the analyzer of the present invention provides only a small background. No approximation is used and that the charged particles can be focused over a wide solid angle are ensured. In the analyzer of the present invention, the sold angle of about 6.28 steradian can be measured which is three times as wide as about 1.8 steradian measured by the analyzer of FIG. 3.

While only certain embodiments of the present invention have been described, it will be apparant to those skilled in the art that various changes and modifications may be made therein without departing from the spirit and scope of the present invention as claimed.

What is claimed is:

1. A charged particle analyzer comprising:

spherical grid means;

spherical electrode means, said spherical electrode means being concentric with said spherical grid means;

a screen plate disposed at said spherical grid means and having a window for entry of charged particles and an exit opening for said charged particles to detector means; and detector means disposed adjacent said exit opening of said screen plate for detecting the charged particles.

2. The analyzer as set forth in claim 1, wherein the entry window and the exit opening of said screen plate is symmetrical with respect to the center of the sphere of said spherical grid means.

3. The analyzer as set forth in claim 1, wherein said detector means is of two-dimensional type.

4. The analyzer as set forth in claim 1, wherein a sample is positioned at the entry window of said screen plate.

5. The analyzer as set forth in claim 1, wherein the charged particles traveling to said exit opening travel in elliptical orbits and are emitted from the entry window at specific angles and are introduced back into said exit opening at the same said specific angles.

6. The analzyer as set forth in claim 1, wherein the radius of said spherical electrode means is approximately double the radius of said spherical grid means.

7. The analyzer as set forth in claim 1, further comprising guard ring means provided between said spherical grid means and said spherical electrode means.

8. The analyzer as set forth in claim 7, further comprising power supply means, connected to said spherical electrode means, for controlling the value of the energy of which charged particles are detected.

9. The analyzer as set forth in claim 1, wherein both said spherical electrode means and said spherical grid means are provided with hole means through which an excitation ray is incident upon the entry window of said screen plate.

10. The analyzer as set forth in claim 1, wherein said detector means is a fluorescent screen.

11. The analyzer as set forth in claim 1, further comprising high pass filter means disposed under the exit opening of said screen plate.

12. The analyzer as set forth in claim 1, wherein the solid angle of said spherical grid means is not 2 $\pi$ steradian, for instance, smaller than 2 $\pi$ steradian or about 4 $\pi$ steradian.

* * * * *